US005335988A

United States Patent [19]

Lynn et al.

[11] Patent Number: 5,335,988

[45] Date of Patent: Aug. 9, 1994

[54] FOIL ACCESS COVER FOR REFRIGERATION DECK

[75] Inventors: Shelby A. Lynn, Johnson Township, Gibson County, Ind.; Donald R. Howerton, Liverpool, N.Y.

[73] Assignee: Whirlpool Corporation, Benton Harbor, Mich.

[21] Appl. No.: 12,669

[22] Filed: Feb. 3, 1993

[51] Int. Cl.[5] ..... F25D 11/00

[52] U.S. Cl. ..... 312/406.2; 220/444; 220/902; 220/467; 312/406

[58] Field of Search ..... 312/406, 406.1, 406.2, 312/; 264/45.6; 220/444, 467, 902

[56] References Cited

U.S. PATENT DOCUMENTS

| | | | |
|---|---|---|---|
| 3,152,199 | 10/1964 | Roberts . | |
| 3,288,896 | 11/1966 | Hendricks | 265/46.5 |
| 3,512,323 | 5/1970 | Hupfer . | |
| 3,883,198 | 5/1975 | Tillman | 312/406.2 |
| 3,940,195 | 2/1976 | Tillman | 312/406.1 |
| 4,006,947 | 2/1977 | Haag et al. . | |
| 4,097,096 | 6/1978 | Kochendorfer | 312/406 |
| 4,102,721 | 7/1978 | Carey, Jr. . | |
| 4,527,543 | 7/1985 | Denton | 220/444 |
| 4,715,512 | 12/1987 | Buchser | 312/406 |
| 4,771,532 | 9/1988 | Taylor, Jr. et al. . | |

FOREIGN PATENT DOCUMENTS

| | | | |
|---|---|---|---|
| 2320752 | 4/1973 | Fed. Rep. of Germany | 220/444 |

*Primary Examiner*—Kenneth J. Dorner
*Assistant Examiner*—Gerald A. Anderson
*Attorney, Agent, or Firm*—Thomas J. Roth; Stephen D. Krefman; Thomas E. Turcotte

[57] ABSTRACT

A refrigeration apparatus cabinet has an outer shell and an inner liner to define an insulation space therebetween. The shell has a deck including an enlarged opening. A conduit extends downwardly along a rear wall of the liner, with a distal end extending through the deck opening. A foil access cover is adhered to the deck about the opening to cover the opening, with the conduit extending outwardly from the space. A body of foamed-in-place insulation is provided in the space, with the access cover sealing the deck opening to prevent leakage of the foamed-in-place insulation.

10 Claims, 2 Drawing Sheets

FOIL ACCESS COVER FOR REFRIGERATION DECK

FIELD OF THE INVENTION

This invention relates to refrigeration apparatus cabinet construction and, more particularly, to a foil access cover for a refrigerator deck.

BACKGROUND OF THE INVENTION

In one conventional method of forming a refrigeration apparatus cabinet, a liner is spaced from a shell and foamed-in-place insulation is formed therebetween. To provide electrical power to electrical apparatus within the refrigeration cabinet, or to connect components within the sealed refrigeration system, a tunnel is provided between the shell and the liner. The conductors or tubing mounted at a rear wall of the shell pass through the tunnel into the cabinet.

In some instances, it is desirable to provide the conductors or tubing in the space between the shell and the liner embedded in the foamed-in-place insulation. While the routing of the conductors or tubing in the space is straightforward, problems result where these devices exit the space. Particularly, a process opening must be provided in the shell, commonly in the deck. However, expanding foam insulation tends to escape through any opening. To prevent such escape, foam stops must be provided for stopping the foaming action at the opening. Moreover, any covering of such openings must be satisfactory to meet U.L. requirements for a metal barrier.

The present invention is directed to solving one or more of the problems discussed above in a novel and simple manner.

SUMMARY OF THE INVENTION

In accordance with the invention, there is disclosed a foil access cover overlying a deck opening to prevent leakage of insulation.

Broadly, there is disclosed herein a method of assembling a refrigeration apparatus cabinet comprising the steps of providing a liner assembly, the liner assembly including the liner and a conduit means extending downwardly along a rear wall of the liner, positioning the cabinet shell surrounding the liner to define a space therebetween, the shell including a deck having a deck opening with a distal end of the conduit means extending through the deck opening, adhering a foil access cover to the deck about the opening to cover the opening with the conduit means extending outwardly from the space, and injecting a foamed-in-place insulation into the space, the access cover sealing the deck opening to prevent leakage of the foamed-in-place insulation.

It is a feature of the invention that the providing step comprises providing the conduit means with a grommet and the positioning step comprises installing the grommet in the deck opening partially surrounded by the deck, the adhering step comprising positioning the access cover to surround a portion of the grommet not surrounded by the deck.

It is another feature of the invention that the adhering step comprises providing an aluminum foil access cover of a size larger than the deck opening.

It is a further feature of the invention that the adhering step comprises providing an adhesive backed foil access cover of a size larger than the deck opening.

There is disclosed in accordance with another aspect of the invention a refrigeration apparatus cabinet having an outer shell and an inner liner to define an insulation space therebetween. An improvement therein comprises a deck fastened to the shell, the deck defining a bottom wall of the insulation space. An enlarged opening is provided through the deck. A conduit extends downwardly along a rear wall of the liner with a distal end of the conduit extending through the deck opening. A foil access cover is adhered to the deck about the opening to cover the opening with the conduit extending outwardly from the space. Foamed-in-place insulation is provided in the insulation space, the access cover sealing the deck opening to prevent leakage of the foamed-in-place insulation.

It is a feature of the invention that the conduit comprises a drain tube.

It is a further feature of the invention that the conduit comprises a tube connecting components in a sealed refrigeration system.

In accordance with another aspect of the invention, the cover comprises a metal barrier adhered to the deck overlying the opening to cover the opening with the conduit extending outwardly from the space.

Further features and advantages of the invention will be readily apparent from the specification and from the drawing.

DETAILED DESCRIPTION OF THE INVENTION

Figure 1:
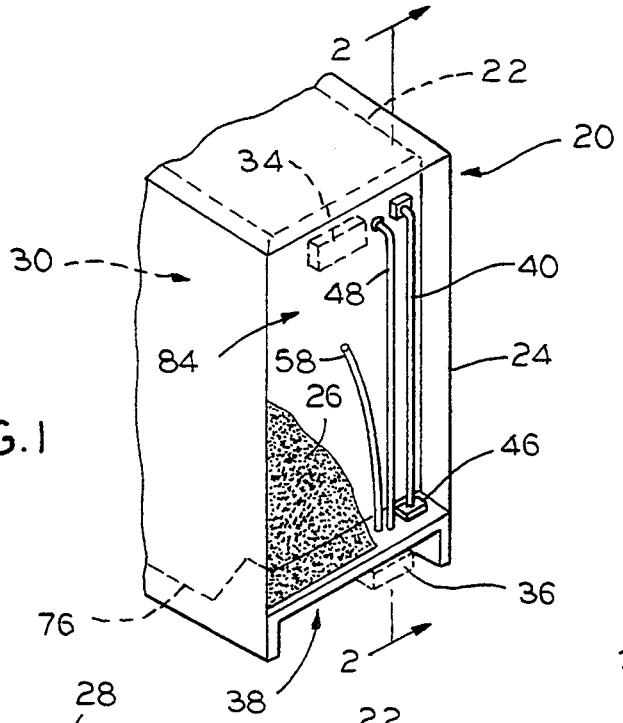
FIG. 1 is a partial, perspective view of a refrigeration apparatus cabinet manufactured according to the invention.
Figure 2:
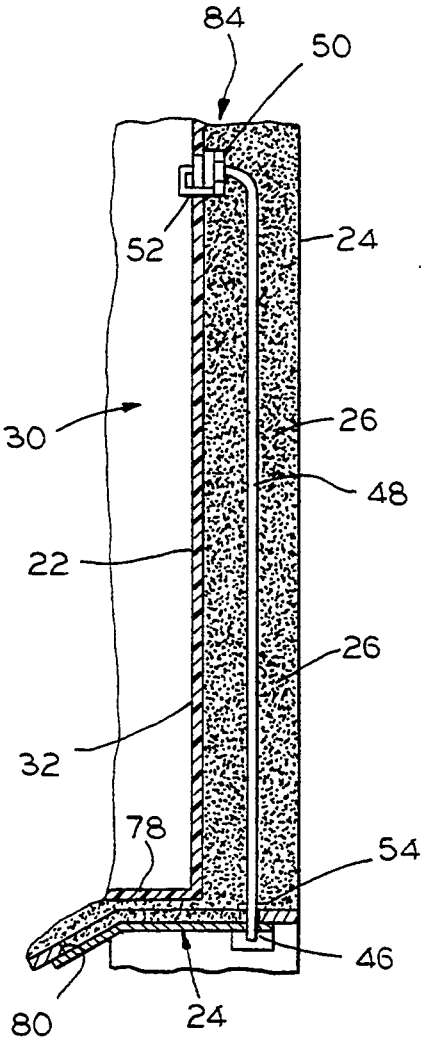
FIG. 2 is a cross-section taken along a line 2—2 of FIG. 1.

In the illustrated embodiment of the invention, as disclosed in the drawing, a cabinet 20 comprises an insulated wall structure defined by a first, inner wall member 22, a second, outer wall member 24 and a body of foamed-in-placed insulation 26 therebetween. In the illustrated embodiment, the cabinet 20 comprises a refrigeration apparatus cabinet wherein the inner wall member 24 comprises a liner and the outer wall member 24 comprises a shell.

The present invention is concerned with the provision of a conduit disposed within the body of foamed-in-place insulation 26 and exiting through the shell 24.

Figure 3:
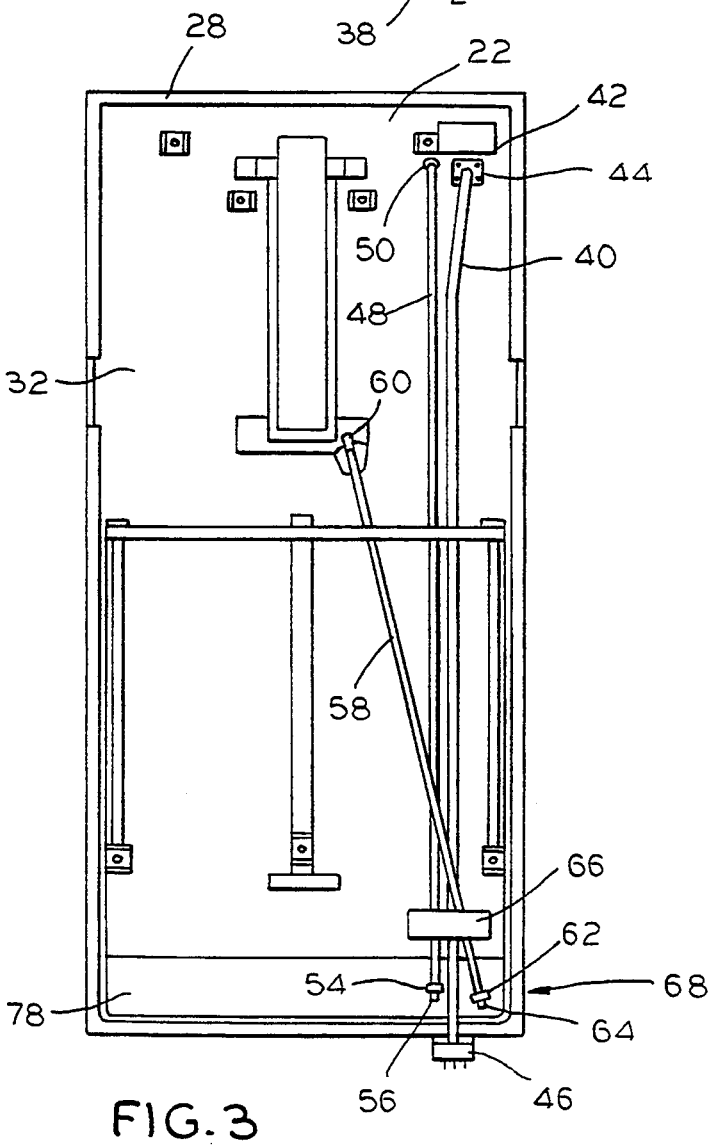
FIG. 3 is a rear elevation view of a liner assembly for the cabinet of FIG. 1.

In the illustrated method of assembling the cabinet 20, a liner assembly 28 is provided as illustrated in FIG. 3 and including the liner 22. The liner 22 is formed to define an internal refrigerated storage space 30 having a rear wall 32. As is conventional, various electrical and refrigeration apparatus are included in the storage space 30. Particularly, the storage space 30 may include refrigeration apparatus 34, such as an evaporator, and other devices which must be connected to additional refrigeration apparatus 36, such as a compressor, in a unit compartment 38 below the outer shell 24. To provide such connection, it is necessary that electrical or fluid conductors extend between the storage space 30 and the unit compartment 38.

To provide the above-described connections, a wiring harness 40 is positioned along the liner rear wall 32. The wiring harness 40 includes a first connector 42 received in an opening 44 in the liner rear wall 32 and an opposite second connector 46. The wiring harness may include a conduit carrying the conductors. A heat exchanger assembly conduit in the form of a tube 48 passes via a sealed connector 50 through an additional opening 52 in the liner rear wall 32. The tube 48 is used for connection to the evaporator 34. A grommet 54 surrounds the tube 48 at a lower end 56 thereof. An additional conduit in the form of a drain tube 58 extends through a third liner rear wall opening 60 and also extends downwardly along the liner rear wall 32. A grommet 62 surrounds the drain tube 58 at a lower end 64. A piece of adhesive tape 66 is used for maintaining alignment of the wiring harness 40 and the tubes 48 and 58 relative to a bottom portion 68 of the liner 22.

Figure 4:
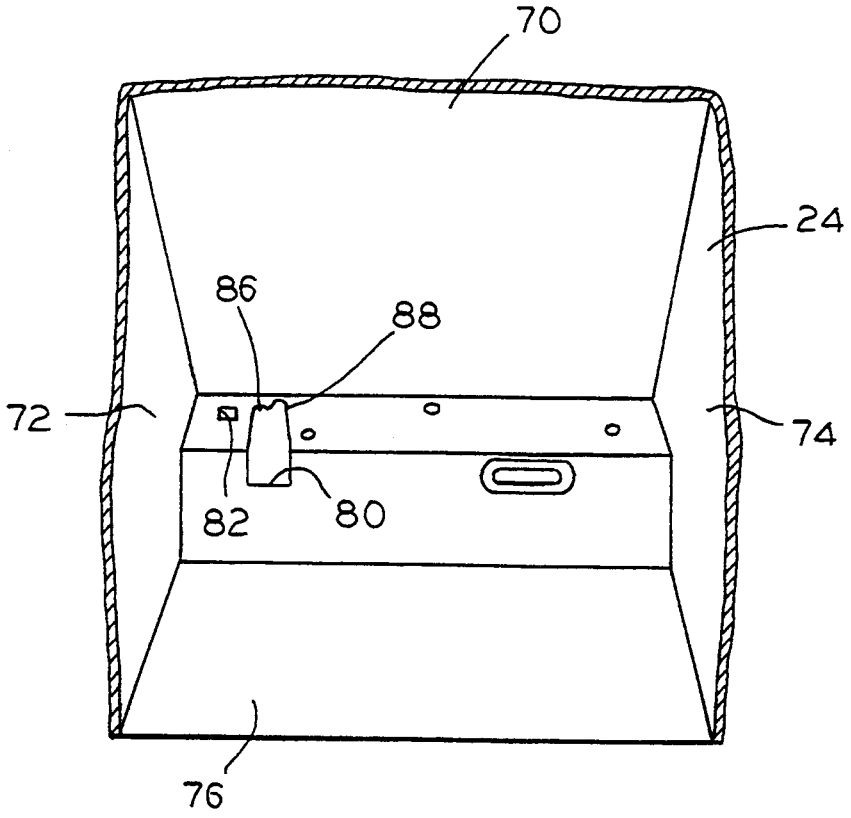
FIG. 4 is a partial, front perspective view of an outer cabinet shell of the cabinet of FIG. 1.
Figure 5:
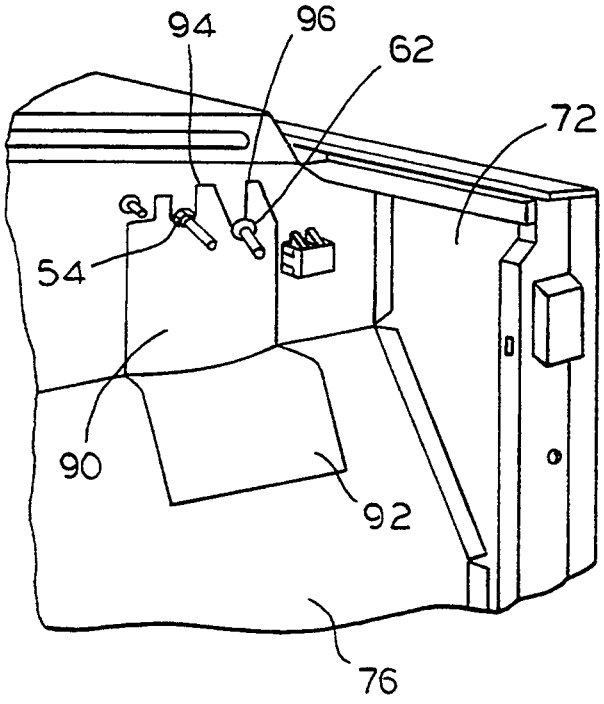
FIG. 5 is a bottom, partial perspective plan view of the cabinet of FIG. 1.

With reference to FIG. 4, the outer shell 24 is illustrated in greater detail. The outer shell 24 includes a rear wall 70 connected between opposite side walls 72 and 74. A deck 76 is connected to each of the walls 70, 72 and 74 to define a bottom wall. The deck 76 is shaped to conform to a corresponding liner bottom wall 78. The deck 76 includes an enlarged process opening 80, along with a smaller, adjacent rectangular opening 82.

In the assembly of the cabinet 20, the cabinet shell 24 is positioned surrounding the liner assembly 28 to define an insulation space 84 therebetween. The wiring harness 40 and tubes 48 and 58 are thus received in the insulation space 84. An installer can then reach through the process opening 80 and insert the harness connector 46 into the opening 82. Incident to the liner assembly 28 being surrounded by the shell 24, the drain tube 50 and heat exchange tubes 48 extend through the process opening 80. The process opening 80 includes two semicircular rounded portions 86 and 88. The grommet 62 is inserted in the rounded portion 86, while the grommet 54 is inserted in the rounded portion 88. Prior to filling the insulation space 84 with the insulation 26, it is necessary that the openings 82 and 80 be sealed. The second connector 46 itself seals the opening 82. In accordance with the invention, a foil access cover 90 is provided for sealing the process opening 80. The cover 90 is of aluminum foil of a size greater than the size of the opening 80. The top side of the foil has pressure sensitive adhesive with a removable backing strip. To apply the cover 90, the backing strip is removed and the cover 90 placed in overlying relationship with the opening 80, with the outer distal edges 92 adhering to the deck 76 about the opening 80. Notches 94 and 96 are provided at one end of the cover 90 to surround the grommets 54 and 62 at those portions which are not surrounded by the opening rounded portions 86 and 88. Thus, the access cover 90 closes the process opening 80 before the insulation operation takes place.

Alternatively, the wiring harness 40 could also extend through the process opening 80 and be sealed by the access cover 90, as is apparent.

The access cover 90 prevents leakage of the foamed-in-place insulation. Additionally, the use of an aluminum foil for the cover 90 meets U.L. standards for a metal barrier. After foaming is complete, the insulation body 26 adheres to and provides a solid backup for the cover 90.

Thus, in accordance with the invention, there is illustrated a foil access cover for a process opening in a foamed-in-place refrigeration apparatus cabinet.

We claim:

1. In a refrigeration apparatus cabinet having an outer shell and an inner liner to define an insulation space therebetween, the improvement comprising:

a deck fastened to said shell, said deck defining a bottom wall of said insulation space;

an enlarged opening through said deck;

a conduit extending downwardly along a rear wall of the liner with a distal end of said conduit extending through said deck opening;

a foil access cover adhered to said deck about said opening to cover said opening with said conduit extending outwardly from said space; and a body of foamed-in-place insulation in said space, said access cover sealing said deck opening to prevent leakage of the foamed-in-place insulation.

2. The improvement of claim 1 further comprising a grommet surrounding said conduit and received in said deck opening partially surrounded by said deck, said access cover surrounds a portion of the grommet not surrounded by said deck.

3. The improvement of claim 1 wherein said cover comprises an aluminum foil access cover of a size larger than said deck opening.

4. The improvement of claim 1 wherein said cover comprises an adhesive backed foil access cover of a size larger than said deck opening.

5. In a refrigeration apparatus cabinet having an outer shell and an inner liner to define an insulation space therebetween, the improvement comprising:

a deck fastened to said shell, said deck defining a bottom wall of said insulation space;

an enlarged opening through said deck;

a conduit extending downwardly along a rear wall of the liner with a distal end of said conduit extending through said deck opening;

a body of foamed-in-place insulation in said space and on access cover comprising a metallic barrier sealing said deck opening to prevent leakage of the foamed-in-place insulation with said conduit extending outwardly from said space.

6. The improvement of claim 5 further comprising a grommet surrounding said conduit and received in said deck opening partially surrounded by said deck, said access cover surrounds a portion of the grommet not surrounded by said deck.

7. The improvement of claim 5 wherein said cover comprises an aluminum foil access cover of a size larger than said deck opening.

8. The improvement of claim 5 wherein said cover comprises an adhesive backed foil access cover of a size larger than said deck opening.

9. The improvement of claim 5 wherein said conduit comprises a drain tube.

10. The improvement of claim 5 wherein said conduit comprises a tube connecting components in a sealed refrigeration system.

* * * * *